US008376761B2

(12) United States Patent
Kataoka et al.

(10) Patent No.: US 8,376,761 B2
(45) Date of Patent: Feb. 19, 2013

(54) CONNECTOR

(75) Inventors: Shigeto Kataoka, Yokkaichi (JP); Toshifumi Miyamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/249,403

(22) Filed: Sep. 30, 2011

(65) Prior Publication Data

US 2012/0088413 A1 Apr. 12, 2012

(30) Foreign Application Priority Data

Oct. 8, 2010 (JP) ..... 2010-228899

(51) Int. Cl.
*H01R 13/44* (2006.01)

(52) U.S. Cl. ..... 439/140

(58) Field of Classification Search ..... 439/140, 439/701, 135, 137, 540.1, 587
See application file for complete search history.

(56) References Cited

U.S. PATENT DOCUMENTS

| | | | | |
|---|---|---|---|---|
| 5,295,859 | A * | 3/1994 | Kawai et al. | 439/455 |
| 5,312,268 | A * | 5/1994 | Sumida | 439/364 |
| 5,326,279 | A * | 7/1994 | Sumida | 439/540.1 |
| 5,855,486 | A * | 1/1999 | Fukamachi et al. | 439/157 |
| 6,095,852 | A * | 8/2000 | Gregory, II | 439/540.1 |
| 6,193,531 | B1 * | 2/2001 | Ito et al. | 439/157 |
| 7,172,468 | B2 | 2/2007 | Nishide | |
| 7,699,632 | B2 * | 4/2010 | Hiramatsu | 439/246 |
| 7,985,085 | B2 * | 7/2011 | Gao | 439/137 |

* cited by examiner

*Primary Examiner* — Jean F Duverne
(74) *Attorney, Agent, or Firm* — Gerald E. Hespos; Michael J. Porco; Matthew T. Hespos

(57) ABSTRACT

A rib (54) of a sub-connector (30) is inserted into a groove (22) of a housing (10) if the sub-connector (30) is accommodated inside a correct accommodation concavity (11). A projected strip (77) of a wire cover (70) then is inserted into the groove (22) with the projected strip (77) and the rib (54) being side by side. Thus the wire cover (70) is prevented from being opened. The rib (54) may be inserted into the groove (22) if the sub-connector (30) is accommodated inside an incorrect accommodation concavity (11). But when an operation of mounting the wire cover (70) on the housing (10) in the above-described state is performed, the projected strip (77) interferes with the rib (54) inserted into the groove (22) to stop the mounting the wire cover (70) on the housing (10).

7 Claims, 14 Drawing Sheets

CONNECTOR

BACKGROUND OF THE INVENTION

1. Field of the Invention

The invention relates to a connector.

2. Description of the Related Art

U.S. Pat. No. 7,172,468 discloses a connector with a plurality of sub-connectors, a housing with a plurality of accommodation concavities for receiving the sub-connectors and an electric wire cover mounted on the housing for covering the wires pulled out of the housing.

The electric wire cover is mounted on the body housing after the sub-connectors are inserted into the accommodation concavities. In this state, the electric wire cover is slid along the rear surface of the housing and fixed to the body housing. In this case, the electric wire cover strikes the rear end of the sub-connector that has not been mounted completely into the accommodation concavity. The sub-connector is pressed to the normal position as the operation of sliding the electric wire cover proceeds farther.

Not all sub-connectors are the same, and it is necessary to distinguish the constructions of the sub-connectors from one another prior to inserting the sub-connectors into the respective accommodation concavities. Thus, a rib is formed on each sub-connector, and a concave groove is formed in each accommodation concavity. The sub-connector can be inserted into the accommodation concavity if the rib and the groove correspond. On the other hand, the rib and the groove will not correspond if an attempt is made to insert the sub-connector into the wrong accommodation concavity, and the sub-connector insertion operation is prevented.

There is a fear that sufficient force on the above-described sub-connector will cause the rib to bulge a wall of the accommodation concavity sufficiently for the wrong sub-connector or an improperly oriented sub-connector to be inserted to a normal depth in the accommodation concavity.

The invention has been completed in view of the above-described situation and it is an object of the invention to prevent a sub-connector from being mounted erroneously in a housing.

SUMMARY OF THE INVENTION

The invention relates to a connector with a plurality of sub-connectors. Each sub-connector has a rib and the ribs are formed on the sub-connectors at different positions. The connector also includes a housing with a plurality of accommodation concavities into which the sub-connectors can be inserted. Each accommodation concavity has a concave groove for receiving the rib of one of the sub-connectors. An electric wire cover is mounted on the housing to cover electric wires pulled out of the housing and a projected strip projects from the cover toward the housing. The rib is inserted into the corresponding groove and the projected strip is inserted into the groove alongside the rib if the electric wire cover is mounted on the housing with the sub-connector accommodated correctly in the accommodation concavity. Thus, the electric wire cover is prevented from being opened. An operation of mounting the electric wire cover on the body housing could be attempted with a sub-connector accommodated in the wrong accommodation concavity and the rib in the corresponding groove. However, the projected strip interferes with the rib in the groove and prevents the wire cover from being mounted on the housing.

The sub-connector can be accommodated in the wrong accommodation concavity with the rib inserted in the wrong groove. However, the projected strip of the wire cover will interfere with the rib in the groove, thereby stopping the operation of mounting the wire cover on the housing. The inability to mount the wire cover on the housing is a signal to the operator that the sub-connector is mounted on the wrong accommodation concavity. The groove is used commonly for the rib and the projected strip when the sub-connector takes the normal mounting posture. Thus the construction of the housing is simplified.

A reverse insertion prevention parts preferably is formed on an outer surface of each sub-connector and an inner surface of each accommodation concavity to prevent an upside down accommodation of the sub-connector in the accommodation concavity. Thus, an inverted sub-connector cannot be inserted into the accommodation concavity.

DETAILED DESCRIPTION OF THE PREFERRED EMBODIMENTS

Figure 1:
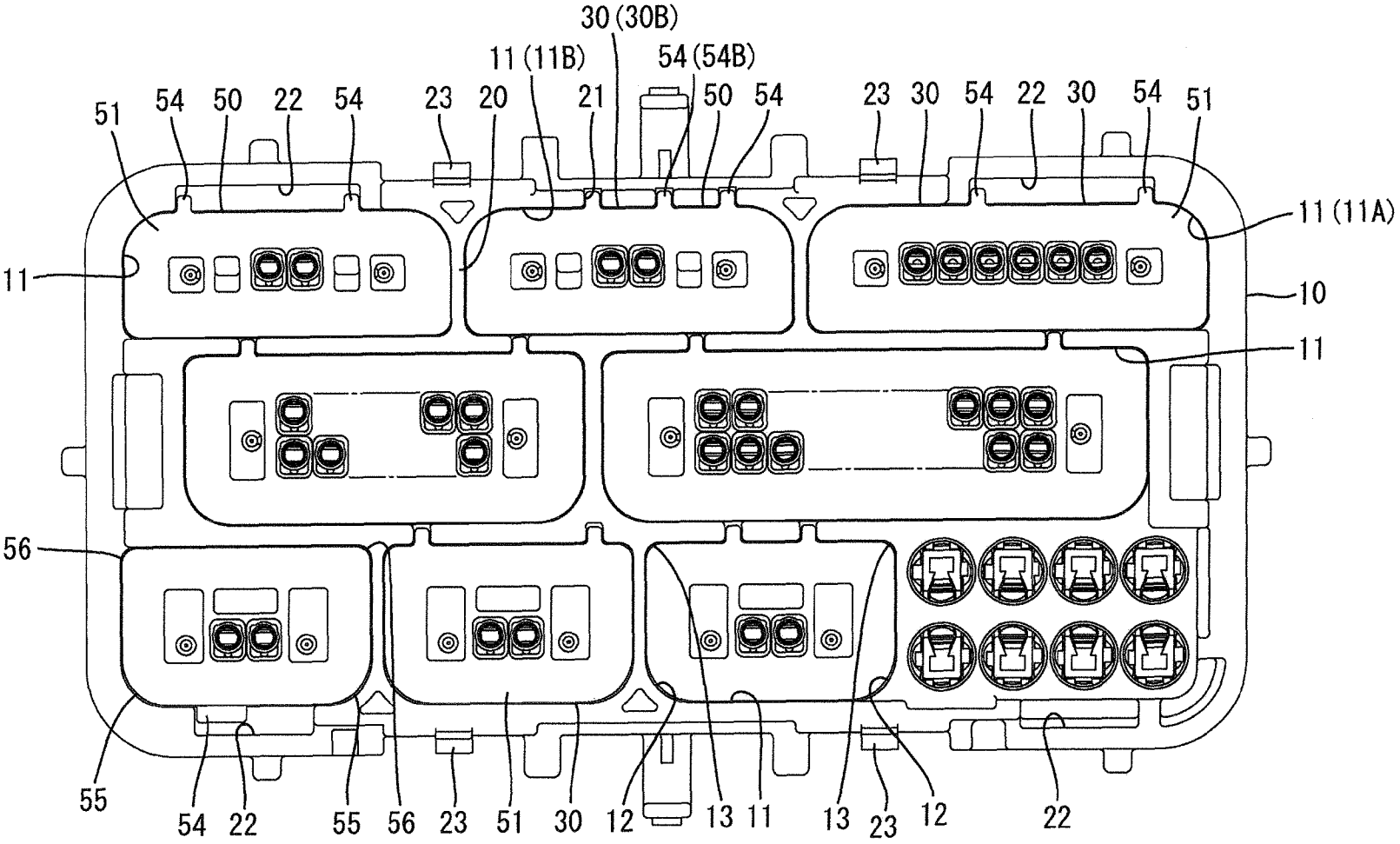
FIG. 1 is a rear view of a connector in accordance with the invention.

A connector in accordance with the invention has a housing 10, a sub-connector 30 and an electric wire cover 70. The sub-connector 30 has a sub-housing 31, a collective rubber stopper 40, and a holder 50. The connector can be fit on a mating connector (not shown). The end of the housing 10 that is fit on the mating housing is referred to as the front herein and reference to the vertical direction is based on the orientation in FIG. 1.

Figure 2:
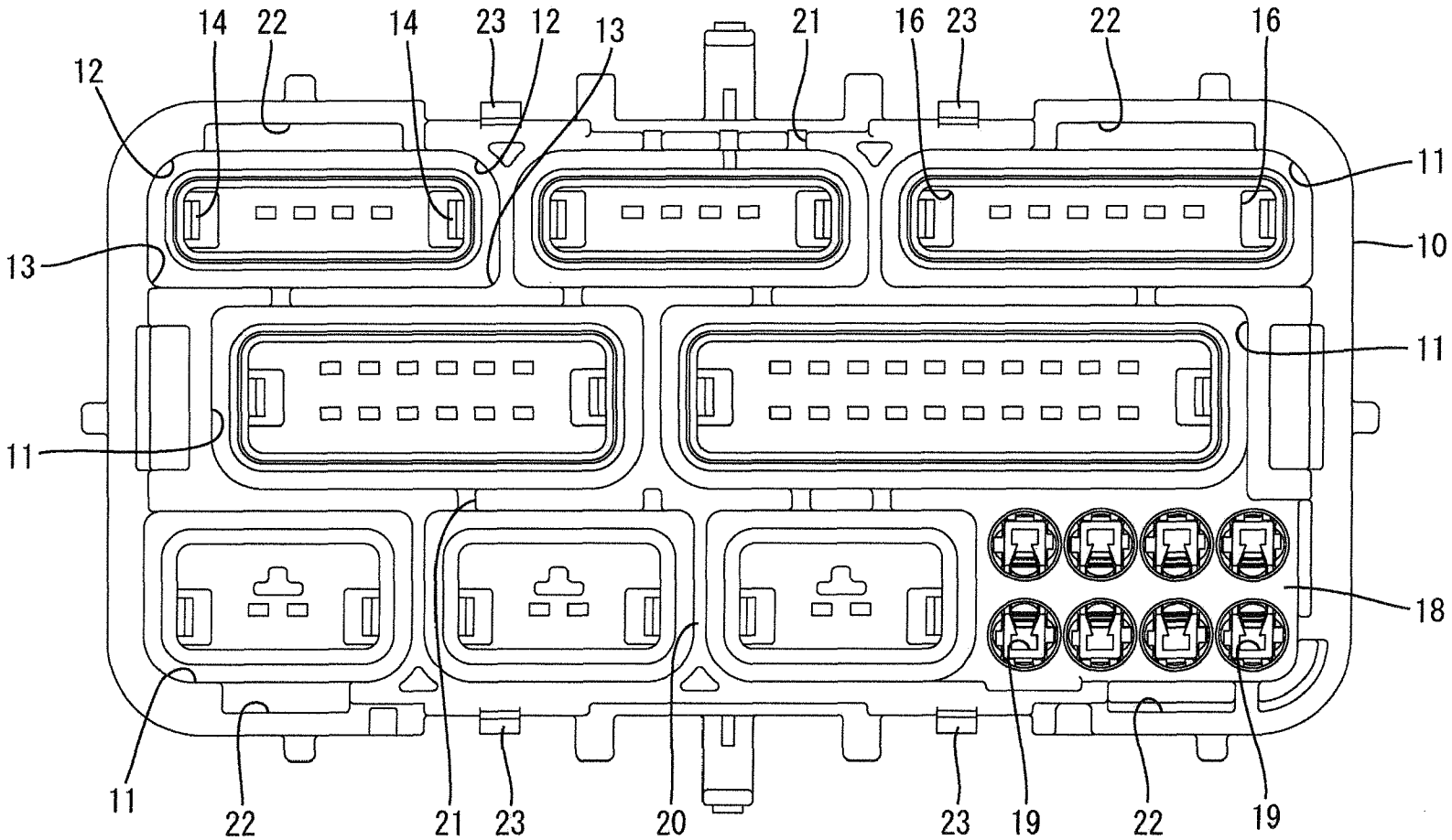
FIG. 2 is a rear view of a housing of the connector.
Figure 3:
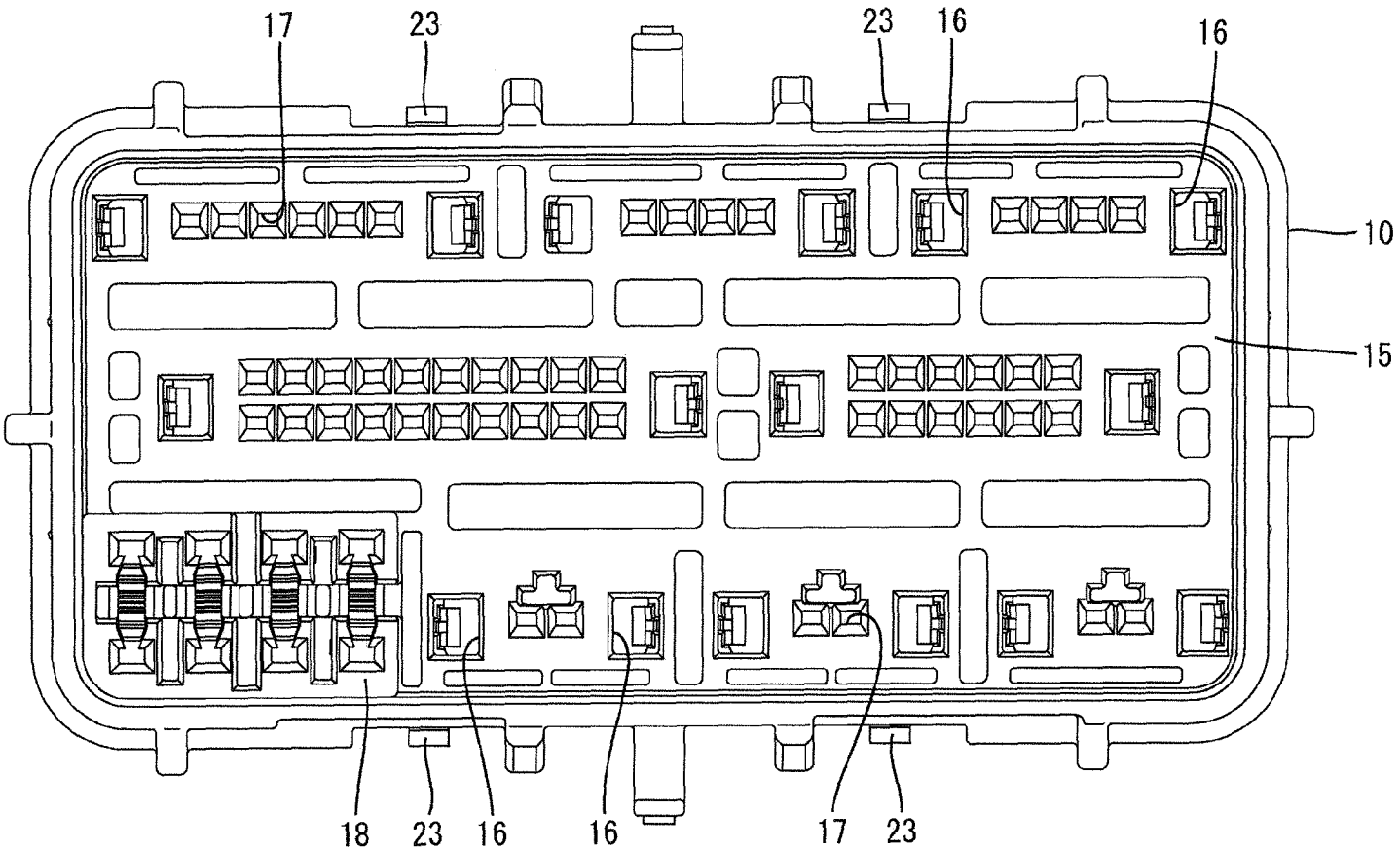
FIG. 3 is a front view of the housing.

The housing 10 is made of a synthetic resin and, as shown in FIGS. 1 through 3, has the shape of a large rectangular box. A plurality of accommodation concavities 11 are formed inside the housing 10 in three steps in the vertical direction and in a plurality of rows in the width direction thereof. Rear ends of the accommodation concavities 11 are open at a rear surface of the housing 10 and open portions of the accommodation concavities 11 are differently configured. The sub-connectors 30 can be inserted into the accommodation concavities 11 from the rear and accommodated therein. The open edge of each accommodation concavity 11 is constructed by differentiating the configurations of upper and lower corners at both ends in the width direction. More specifically, one of the upper and lower corners of the open edge of each accommodation concavity 11 defines a first curved surface 12 having a large radius of curvature, whereas the other of the upper and lower corners defines a second curved surface 13 having a small radius of curvature.

Elastically deformable housing locks 14 (see FIG. 2) are formed on both widthwise side surfaces of each accommodation concavity 11. A front wall 15 closes the front end of each accommodation concavity 11 (see FIG. 3). Windows 16 open in the front wall 15 at positions corresponding to both sides of each accommodation concavity 11 in the width direction. A front-end portion of the each housing lock 14 is visible from the front of the accommodation concavity 11 through the windows 16. Tab insertion holes 17 open formed through the front wall 15. A male tab (not shown) of a mating terminal fitting mounted on the mating connector can be inserted into each tab insertion hole 17 from the front. A group 18 of cavities 19 is formed at one side of a lower-end portion of the housing 10 in the width direction thereof separate from the accommodation concavities 11. The cavities 19 are formed in a line in the group 18 and large terminal fittings (not shown) can be inserted into the cavities 19 from the rear.

A peripheral walls 20 surround the accommodation concavities 11 and rib-receiving grooves 21 are formed by cutting out a rear surface of the peripheral wall 20 of each accommodation concavity 11. The rib-receiving grooves 21 are sectionally rectangular. The rib-receiving grooves 21 are open in the corresponding accommodation concavity 11 and extend in the longitudinal direction of the accommodation concavity 11. The rib-receiving grooves 21 that open on the lower row of accommodation concavities 11 also open on the intermediate row of accommodation concavities 11 except one rib-receiving groove 21. The rib-receiving grooves 21 that open on the intermediate row of accommodation concavities 11 also open on the upper row of accommodation concavities 11. The rib-receiving grooves 21 that open on the upper row of accommodation concavities 11 also open on the upper surface of the housing 10.

Two concave grooves 22 are formed at each of upper and lower ends of the rear surface of the housing 10. Each concave grooves 22 is extended widthwise narrower than the rib-receiving groove 21 and extends longitudinally. The concave groove 22 at one side of the lower portion of the housing 10 in its width direction is disposed along the lower end of the group 18 of the cavities 19, whereas the remaining concave grooves 22 are open on the accommodation concavities 11 disposed at both sides of the upper row in the width direction and at the other side of the lower row in its width direction where the rib-receiving groove 21 is not open.

The positions of the rib-receiving groove 21 of the accommodation concavity 11 and the concave grooves 22 thereof are different on each accommodation concavity 11. The concave grooves 22 at both sides of the housing 10 are disposed almost symmetrically with respect to the center of the body housing 10 in its width direction.

Two cover-locks 23 project on each of upper and lower surfaces of the housing 10 at positions nearer to the center thereof than the grooves 22. The electric wire cover 70 can be locked elastically to each cover-lock 23.

Figure 4:
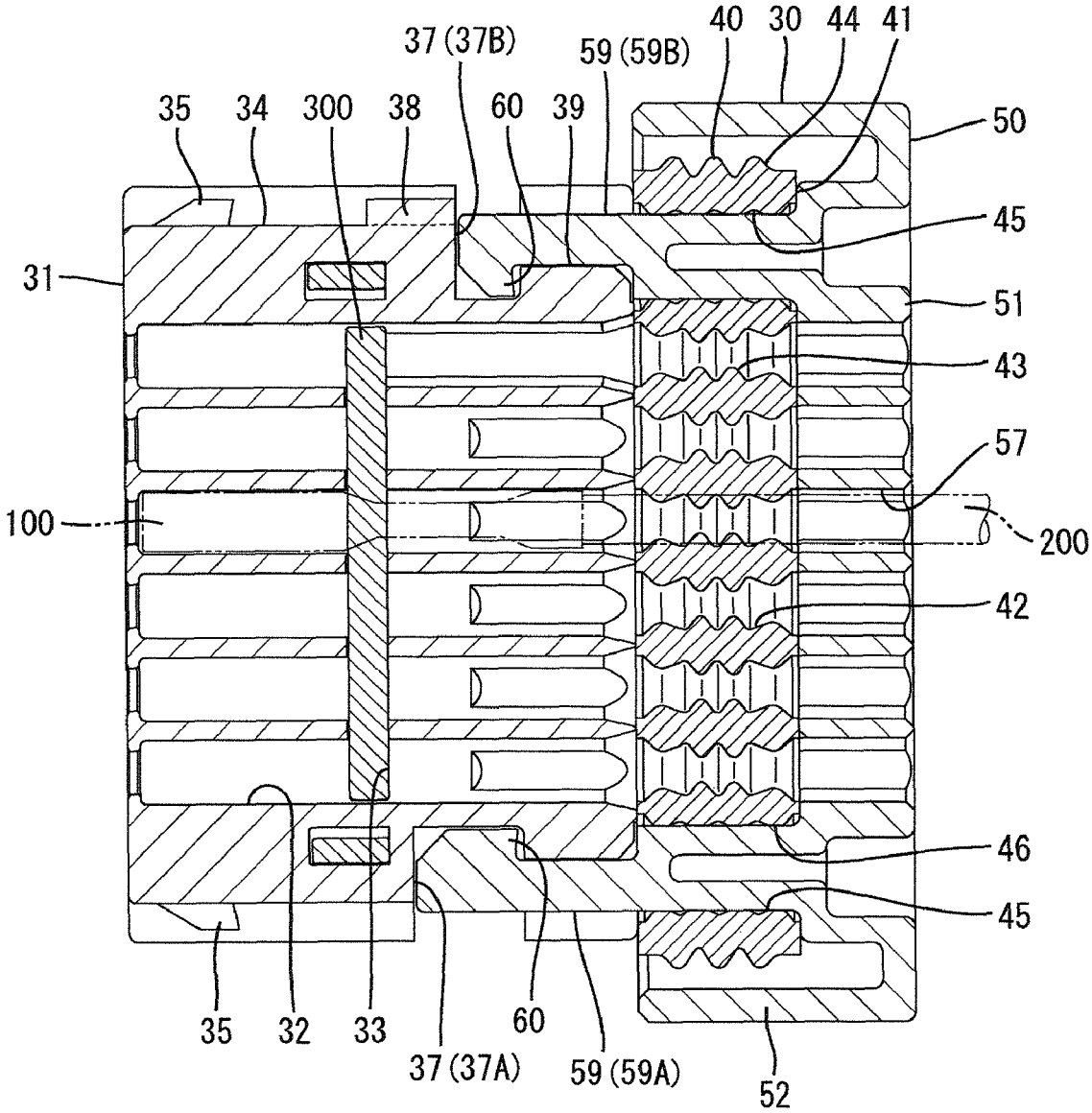
FIG. 4 is a sectional view of a sub-connector.

The sub-connectors 30 have different shapes for fitting respectively to the accommodation concavities 11. Each sub-connector 30 has a sub-housing 31 made of a synthetic resin. As shown in FIG. 4, cavities 32 are formed in a lateral array inside the sub-housing 31 and a terminal fitting 100 is insertable into each cavity 32 from the rear. The terminal fitting 100 is connected to an end of an electric wire 200. The electric wires 200 are pulled out rearward from the rear surface of the sub-connector 30 when the terminal fittings 100 are inserted into the respective cavities 32.

Figure 9:
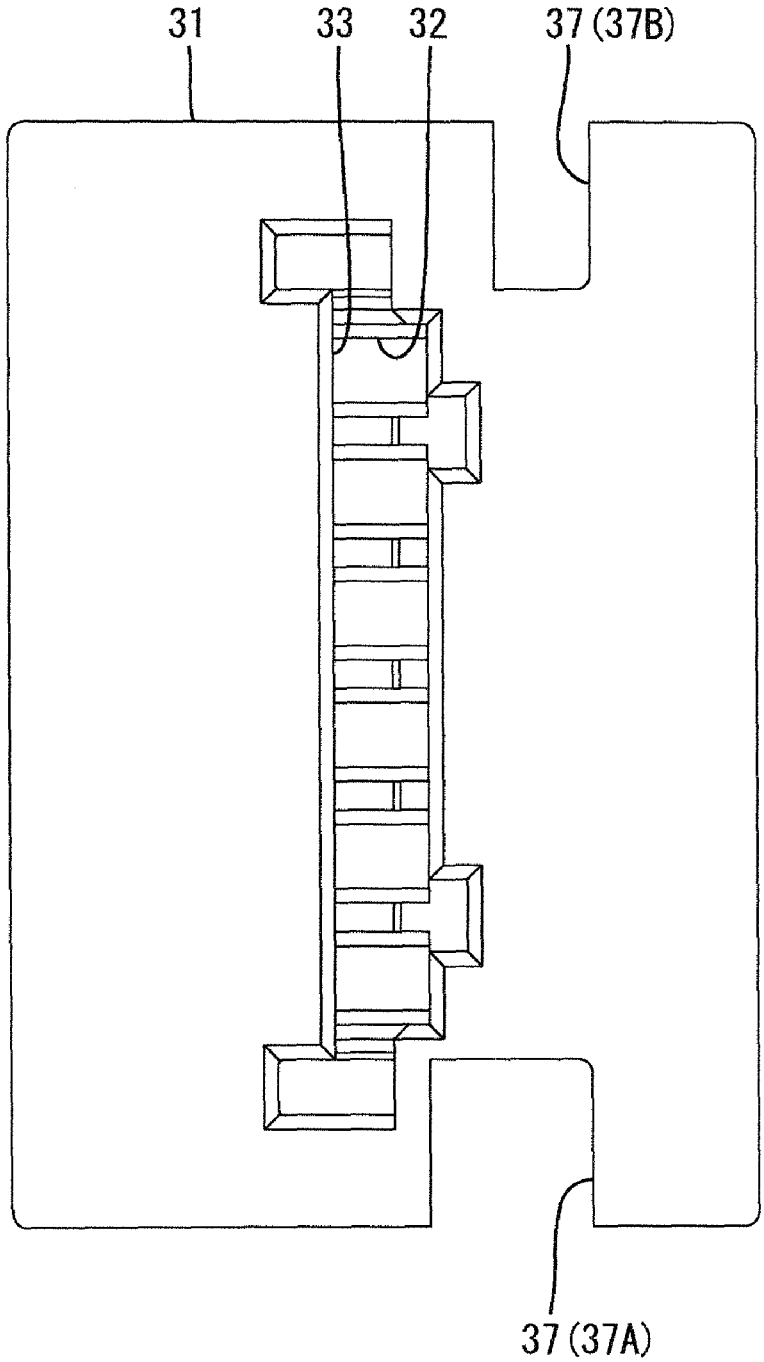
FIG. 9 is a bottom view of a sub-housing.
Figure 10:
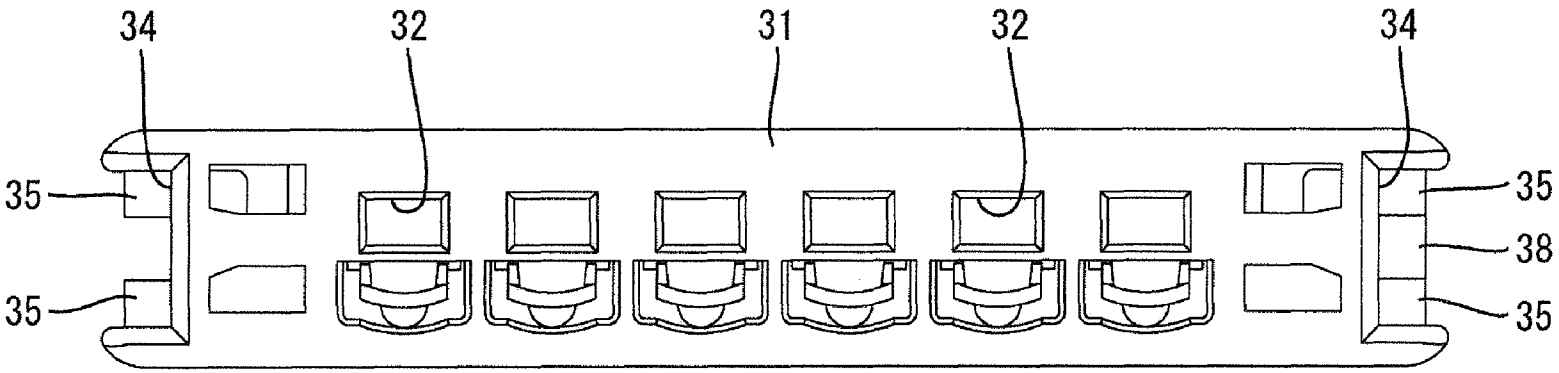
FIG. 10 is a front view of the sub-housing.

As shown in FIG. 9, a mounting hole 33 extends widthwise on a lower surface of the sub-housing 31 and communicates with all of the cavities 32. A retainer 300 is inserted into the mounting hole 33. The retainer 300 is movable between a temporary locking position where the retainer 300 is inserted deeply into the mounting hole 33 and a main locking position where the retainer 300 is inserted shallowly therein. The retainer 300 is offset from the cavities 32 at the temporary locking position to allow the terminal fittings to be inserted into the cavities 32 and removed therefrom. The retainer 300 moves into the cavities 32 at the main locking position to prevent the terminal fittings from being removed from the cavities 32.

Figure 11:
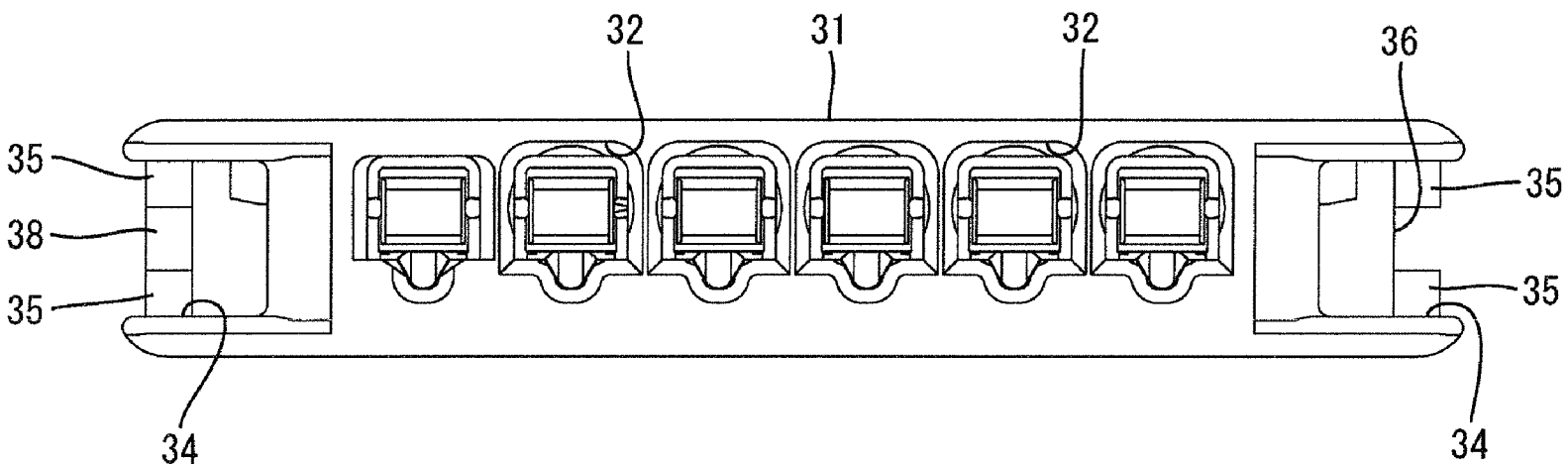
FIG. 11 is a rear view of the sub-housing.
Figure 12:
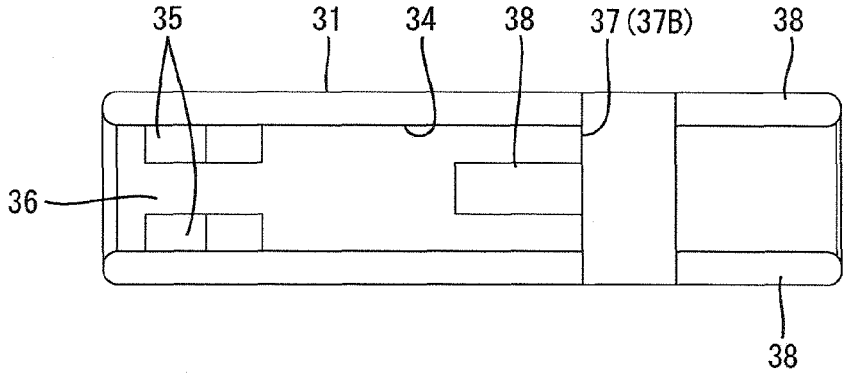
FIG. 12 is a side view of the sub-housing.

As shown in FIGS. 11 and 12, a guide groove 34 is formed on each side surface of the sub-housing 31 in the width direction and extends in the longitudinal direction. A locking projection 35 is formed inside each guide groove 34 near front end of the sub-housing 31. The locking projection 35 is divided vertically into two portions and a jig insertion groove 36 is formed between the two portions of the locking projection 35. The housing lock 14 is inserted into the guide groove 34 from the front in the process of accommodating the sub-connector 30 inside the accommodation concavity 11 and elastically locks the locking projection 35 when the sub-connector 30 is accommodated in the accommodation concavity 11 in a predetermined depth. Thus, the sub-connector 30 is held securely inside the accommodation concavity 11. A jig (not shown) can be moved through the window 16 of the housing 10 and into the jig insertion groove 36 so that the front end of the jig can deform the housing lock 14 elastically in an unlocking direction. The sub-housing 31 then can be pulled rearward from the accommodation concavity 11.

A lock receiving part 37 is formed concavely on each side surface of the sub-housing 31 in its width direction and open on the upper and lower surfaces of the sub-housing 31. Upper and lower walls 38 partition the guide grooves 34 from each other and are cut out to form the lock receiving parts 37. The lock receiving parts 37 are constructed by differentiating the configurations of the open portions thereof from each other. More specifically, rear ends of the locking part receiving parts 37 are disposed at the same position in the longitudinal direction of the sub-housing 31, whereas front ends of the locking part receiving parts 37 are disposed at different positions in the longitudinal direction thereof. One locking part receiving part 37A has a larger open dimension than other locking part receiving part 37B. The front end of the locking part receiving part 37A is positioned immediately rearward from the mounting hole 33 (see FIG. 4).

A forward wall 38B (see FIG. 4) projects from the guide groove 34 at a position immediately forward from the lock receiving part 37B. The projected distance of the wall 38B is almost equal to that of the locking projection 35. The jig insertion groove 36 is positioned forward from the wall 38B. A front surface of the wall 38B is formed by a slide die for forming the jig insertion groove 36.

The collective rubber stopper 40 is disposed rearward from the sub-housing 31 and has a widthwise narrow body 41 (see FIG. 4) made of rubber, such as silicone rubber. The body 41 closely contacts the rear surface of the sub-housing 31. Electric wire close-contact holes 42 are formed on the body 41 at positions corresponding to the positions of the cavities 32. The electric wires 200 connected respectively to the terminal fittings are inserted in a liquid tight manner into the respective electric wire close-contact holes 42. Inner peripheral lips 43 are formed circumferentially on an inner surface of each electric wire close-contact hole 42. Each inner peripheral lip 43 closely contacts the outer surface of the electric wire 200 elastically. Outer peripheral lips 44 are formed circumferentially on an outer surface of the body 41. Each outer peripheral lip 44 closely contacts an inner wall of the accommodation concavity 11 elastically.

Locking strip insertion holes 45 are formed at both ends of the collective rubber stopper 40 in the width direction. Each locking strip insertion hole 45 is sectionally circular and has a larger diameter than the electric wire close-contact hole 42. Inner peripheral lips 46 are formed circumferentially on an inner surface of each locking strip insertion hole 45.

Figure 7:
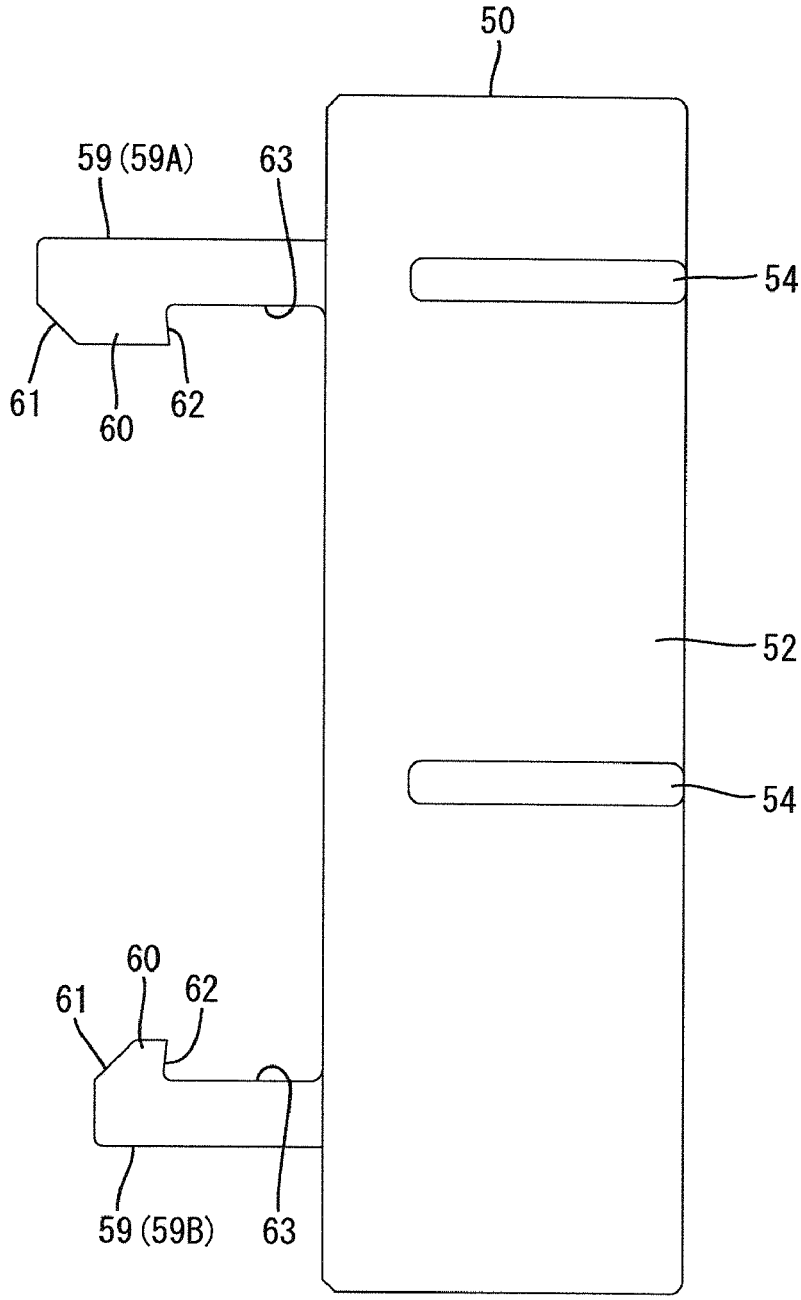
FIG. 7 is a plan view of the holder.
Figure 8:
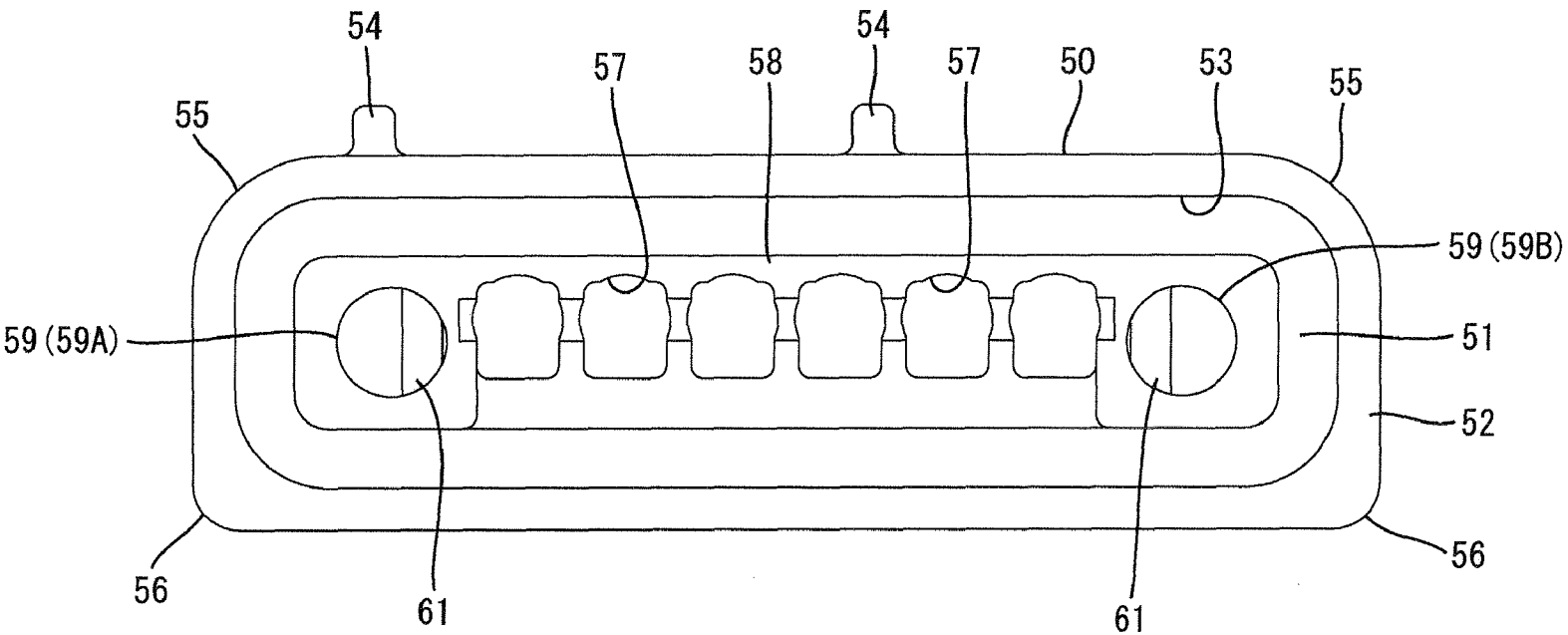
FIG. 8 is a front view of the holder.

The holder 50 is disposed rearward from the sub-housing 31 so that the collective rubber stopper 40 is between the sub-housing 31 and the holder 50. The holder 50 is made of a synthetic resin and has cap-shape. The holder 50 is a little larger than the sub-housing 31 so that the holder 50 projects out beyond the sub-housing 31. As shown in FIGS. 7 and 8, the holder 50 has a widthwise narrow body 51 and a tube 52 projects forward from the periphery of the body 51. A rubber stopper accommodation part 53 is formed inside the holder 50 and can accommodate the collective rubber stopper 40.

Figure 5:
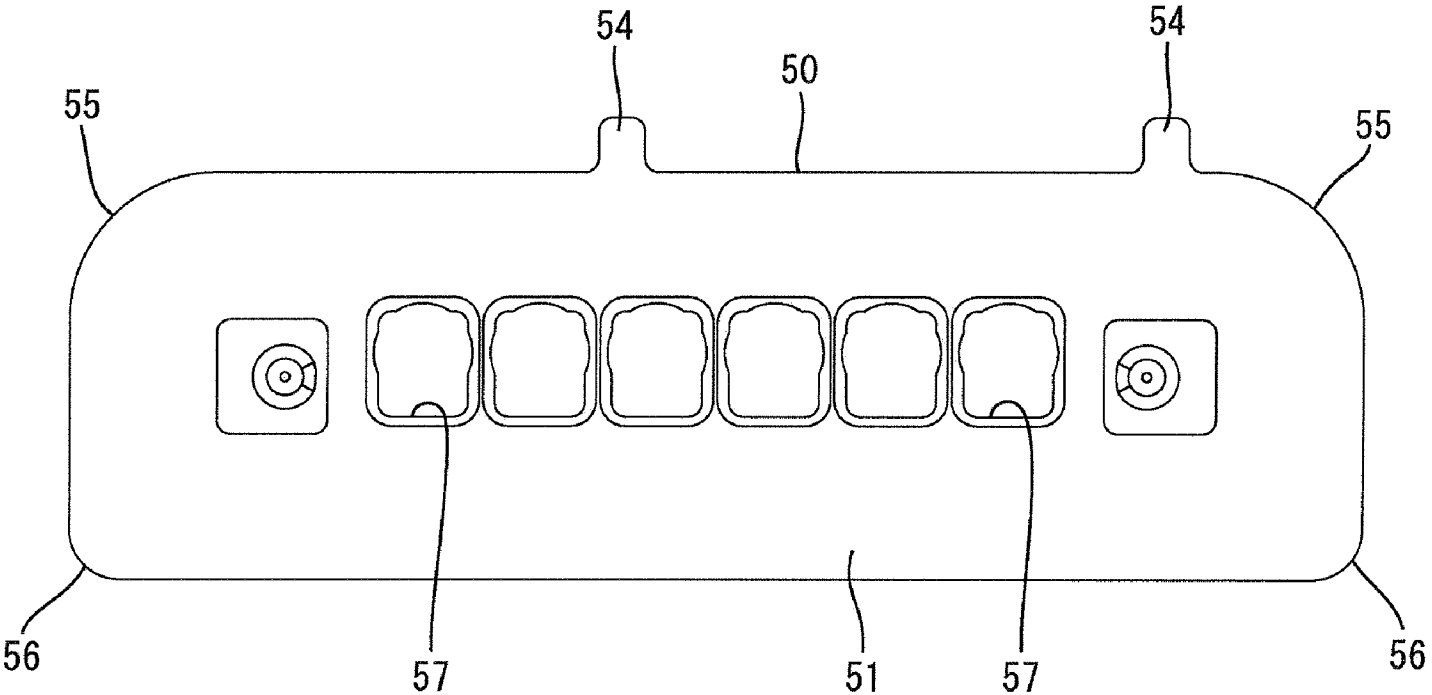
FIG. 5 is a rear view of a holder.
Figure 6:
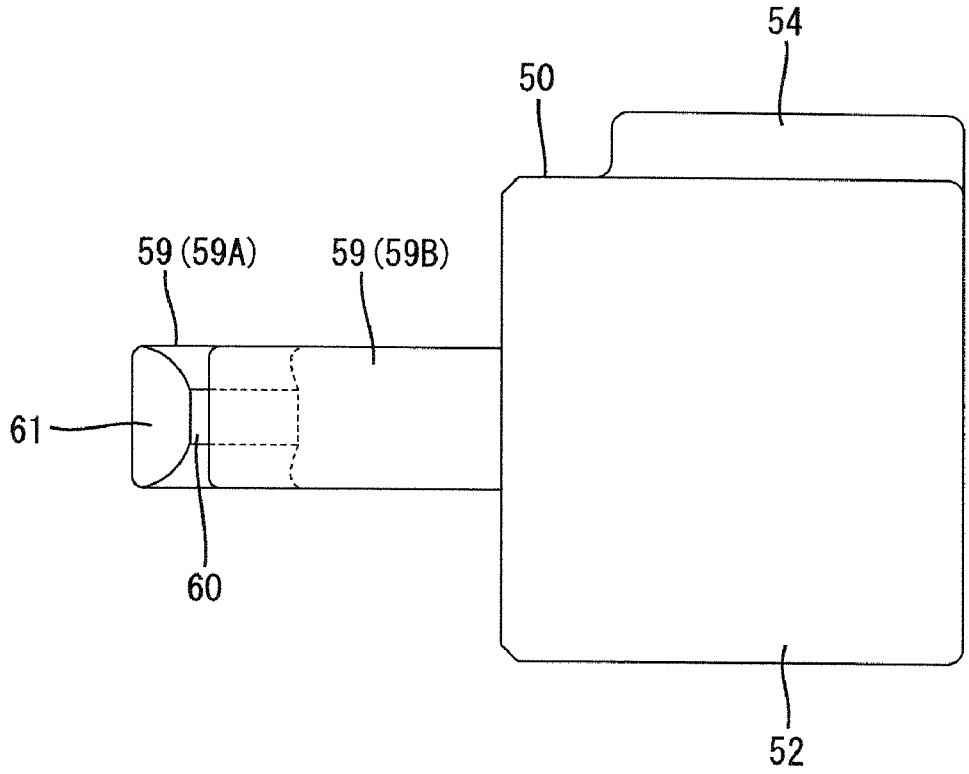
FIG. 6 is a side view of the holder.

As shown in FIGS. 5 and 6, ribs 54 project on an outer surface of the tube 52 and extend rearward in the longitudinal direction from a front end of the tube 52. Each rib 54 is insertable into the corresponding rib-receiving groove 21 or the concave groove 22. The positions where the ribs 54 are disposed are different according to the sub-connector 30.

The configuration of the outer edge of the body 51 corresponds to that of the accommodation concavity 11. One of upper and lower corners of the outer surface of the body 51 is set as a third curved surface 55 corresponding to the first curved surface 12 of the accommodation concavity 11, whereas the other of the upper and lower corners of the outer surface thereof is set as a fourth curved surface 56 corresponding to the second curved surface 13 of the accommodation concavity 11.

Electric wire insertion holes 57 extend through the body 51 at positions corresponding to the cavities 32 and the electric wire close-contact holes 42. The electric wires 200 connected to the terminal fittings 100 are inserted through the electric wire insertion holes 57 respectively in a free movable state.

A thick part 58 is formed on a front surface of the body 51 projects into the tube 52 and each of the electric wire insertion holes 57 penetrates through the thick part 58. Locking strips 59 project from a front surface of the thick part 58 at both sides of the electric wire insertion holes 57. The locking strips 59 are columnar and can fit in the respective locking strip insertion holes 45. Each locking strip 59 is elastically deformable in inward and outward directions about a pivot point where the locking strip 59 and the thick part 58 join. A front end of each locking strip 59 is forward of the tube 52. A lock 60 is formed on an inner surface of the locking strip 59.

A tapered guide surface 61 is formed on a front surface of the lock 60. A locking surface 62 (see FIG. 7) having an overhung configuration is formed on a rear surface of the lock 60. The locking surface 62 is formed when a concave portion 63 formed by cutting out the inner surface of the locking strips 59.

Front ends of the locking strips 59 are shifted from each other in the longitudinal direction of the holder 50. In this case, the front end of one locking strip 59A is disposed forward from that of other locking strip 59B. Rear ends of the locks 60 of the locking strips 59A and 58B are disposed at the same position in the longitudinal direction of the holder 50. Thus the longitudinal projected length of the lock 60 of the locking strip 59A is longer than that of the lock 60 of the other locking strip 59B.

The lock 60 of the one locking strip 59A is sized to fit on the one lock receiving part 37A, whereas the lock 60 of the other locking strip 59B is sized to fit on the other lock receiving part 37B. Therefore the lock 60 of the one locking strip 59A cannot fit on the other lock receiving part 37B, whereas the lock 60 of the other locking strip 59B is fittable on the one lock receiving part 37A.

Figure 14:
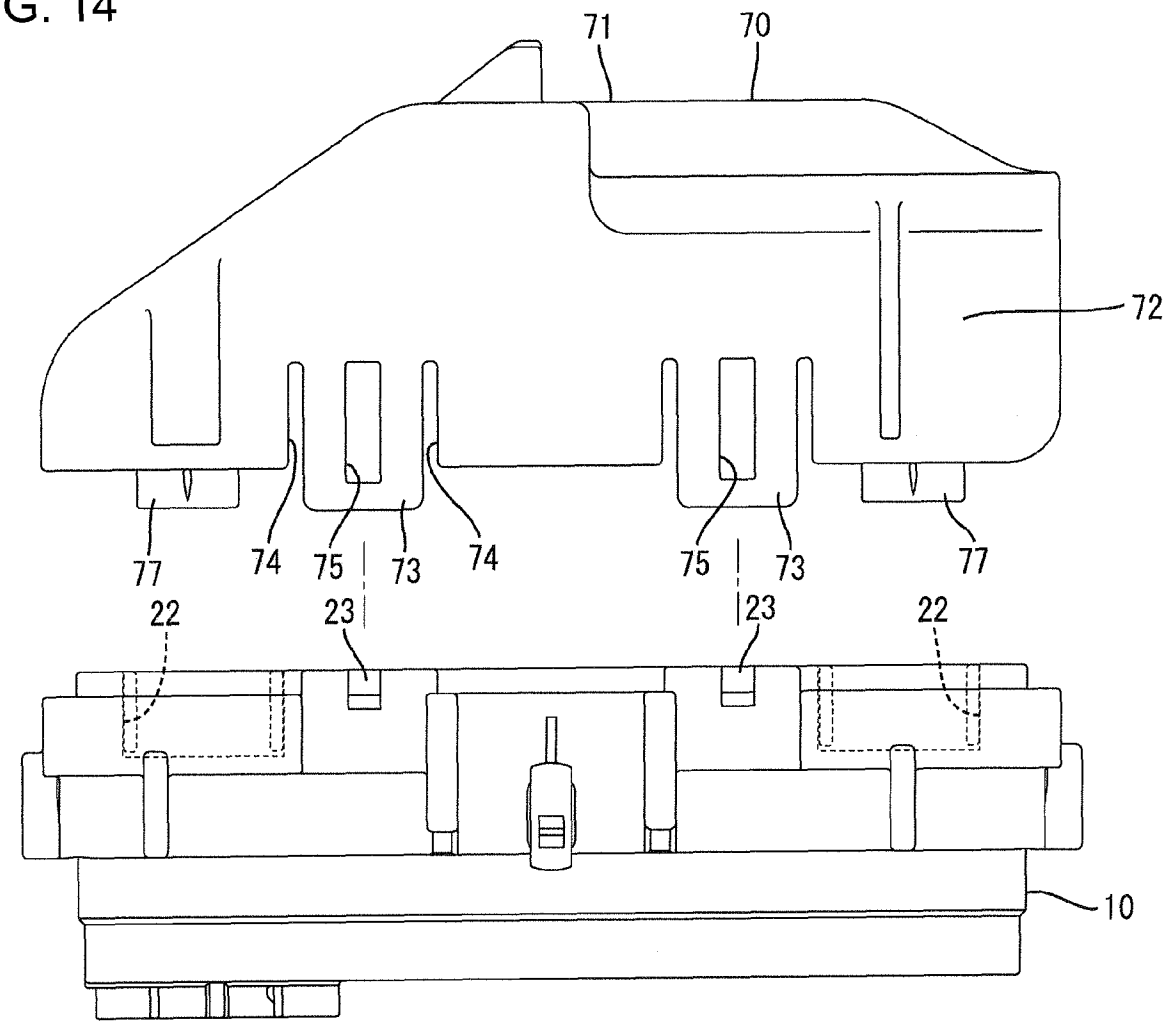
FIG. 14 is a plan view before an electric wire cover is mounted on the housing.

The electric wire cover 70 also is made of the synthetic resin and is cap-shaped. As shown in FIG. 14, the electric wire cover 70 has a rear plate 71 opposed to the rear surface of the housing 10 and two side plates 72 project forward from both edges of the rear plate 71. One side of the electric wire cover 70 in the width direction is closed with the side plates 72, whereas the other side of the electric wire cover 70 in the width direction thereof is open. The electric wire cover 70 is mounted on the body housing 10 with the electric wire cover 70 covering the electric wires 200 pulled out of the rear surface of the sub-connector 30. When the electric wire cover 70 is mounted on the housing 10, the electric wires 200 are forcibly bent by the rear plate 71 to one side in the width direction of the housing 10 and pulled outside the electric wire cover 70.

Locking legs 73 project from a front edge of each side plate 72 in the width direction of the electric wire cover 70. Each locking leg 73 is formed elastically flexibly between a pair of slits 74 that open at the front edge of each side plate 72. A locking hole 75 is formed in each locking leg 73. Two projected strips 77 project from the front edge of each side plate 72 at a position nearer to both ends of the electric wire cover 70 than the locking legs 73. Each projected strip 77 is an approximately rectangular plate. A front end of each projected strip 77 is almost coincident with the front end of the locking leg 73. The projected strip 77 is thicker than the locking leg 73 and is substantially elastically undeformable. The projected strips 77 are disposed in the longitudinal direction of the electric wire cover 70 by locating the projected strips 77 inward from the side plate 72 and shifting the projected strips 77 from the locking legs 73 in the thickness direction of the side plate 72.

The electric wires 200 pulled out of the rear surface of the sub-connector 30 are inserted into the electric wire close-contact holes 42 of the collective rubber stopper 40 and the electric wire insertion holes 57 of the holder 50. Thereafter the holder 50 is mounted on the sub-housing 31 with the collective rubber stopper 40 being accommodated inside the rubber stopper accommodation part 53 of the holder 50. In the process of mounting the holder 50 on the sub-housing 31, the guide surface 61 of the lock 60 contacts the wall 39 on the inner surface of the guide groove 34. As a result, the locking strip 59 deforms elastically out. The locking strip 59 elastically returns to its original state when the holder 50 is mounted properly on the sub-housing 31, as shown in FIG. 4. As a result, the lock 60 is fit on the corresponding lock receiving part 37, with the locking surface 62 of the lock 60 being locked to the rear edge of the lock receiving part 37 to hold the holder 50 by the sub-housing 31. At this time, the front surface of the collective rubber stopper 40 closely contacts the rear surface of the sub-housing 31 and the rear surface of the collective rubber stopper 40 closely contacts the front surface of the thick part 58 of the holder 50.

Figure 13:
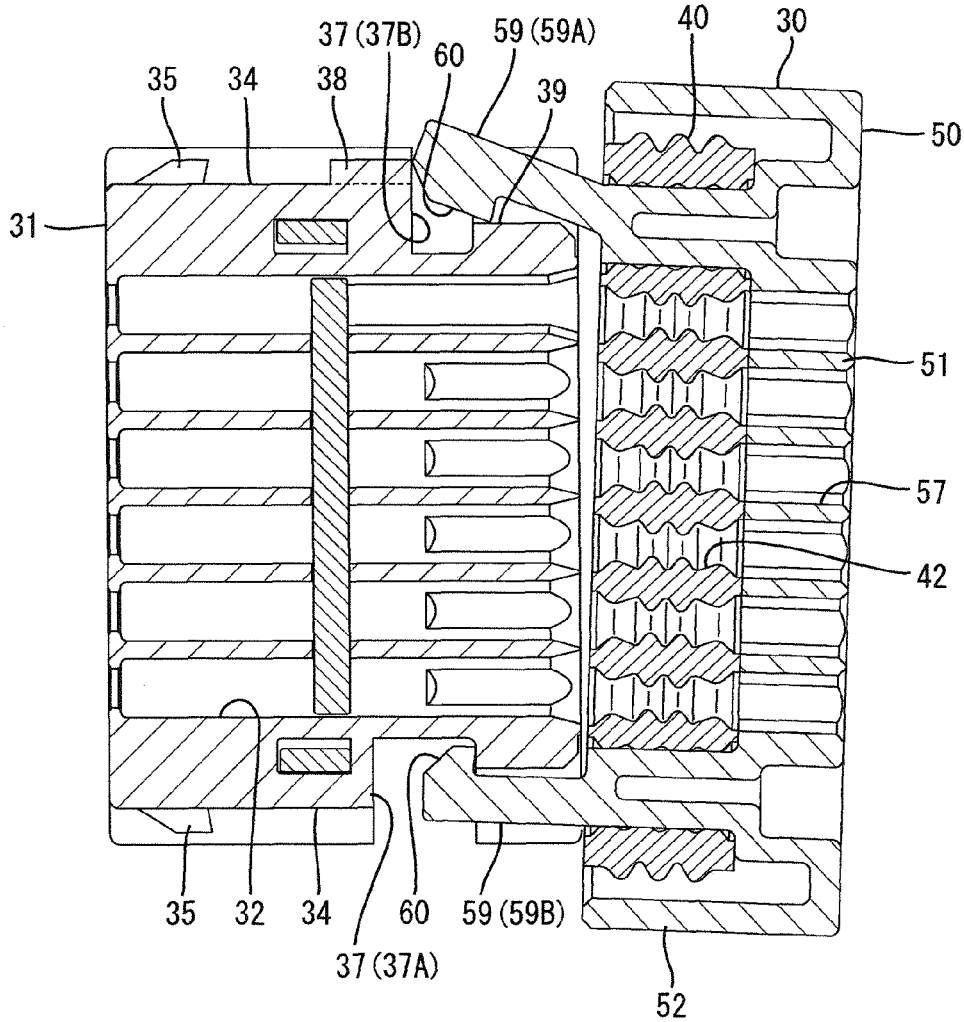
FIG. 13 is a sectional view showing a state in which the holder taking an incorrect posture is not mounted on the sub-housing.

As described above, when the holder 50 takes a proper mounting posture relative to the sub-housing 31, the lock 60 of the one locking strip 59A is fit on the one lock receiving part 37A, with the lock 60 of the other locking strip 59B being fit on the other lock receiving part 37B. On the other hand, when the holder 50 takes an incorrect posture (upside down) relative to the sub-housing 31, as shown in FIG. 13, the lock 60 of the other locking strip 59B is fit on the other locking part receiving part 37B, but the lock 60 of the one locking strip 59A cannot fit on the other lock receiving part 37B and is disposed over the wall 39.

When the holder 50 takes the incorrect posture relative to the sub-housing 31, the locking part 60 of the one locking strip 59A interferes with the wall 38B. Thus, the locking strip 59A is prevented from being pressed further forward. Therefore the holder 50 is not locked to the sub-housing 31 at the side of the one locking strip 59A and separation of the holder 50 from the sub-housing 31 is allowed. When the holder 50 has the incorrect posture relative to the sub-housing 31, the holder 50 has an unfixed state and is oblique to the sub-housing 31 with the front corner of the one locking strip 59A projecting beyond the outer surface of the sub-housing 31. Therefore by visually checking this state, an operator can find easily and with certainty that the holder 50 has the incorrect posture.

The sub-connector 30 is constructed by mounting the holder 50 on the sub-housing 31. Thereafter the sub-connectors 30 are accommodated in the corresponding accommodation concavities 11. The sub-connector 30 primarily is prevented from being accommodated inside the wrong accommodation concavity 11 by inserting the ribs 54 into the corresponding rib-receiving grooves 21 or the concave grooves 22. At this time, as shown in FIG. 1, the ribs 54 fit in the rib-receiving grooves 21 without gaps or are inserted into widthwise ends of the concave groove 22 with gaps defined between the ribs 54 inside the concave groove 22.

When the sub-connector 30 is accommodated in the corresponding accommodation concavity 11 in the correct posture, the body 51 of the holder 50 is fit inside the accommodation concavity 11, and the third and fourth curved surfaces 55 and 56 are disposed along the first and second curved surfaces 12 and 13 respectively. On the other hand, when the operator tries to insert the sub-connector 30 into the corresponding accommodation concavity 11 in an inverted posture, the fourth curved surface 56 interferes with the first curved surface 12 to stop further insertion of the inverted sub-connector 30 into the accommodation concavity 11. Thus, the first through fourth curved surfaces 12, 13, 55, and 56 function as reverse insertion prevention parts, to prevent the sub-connector 30 from being inserted into the accommodation concavity 11 with the sub-connector 30 upside down.

Figure 15:
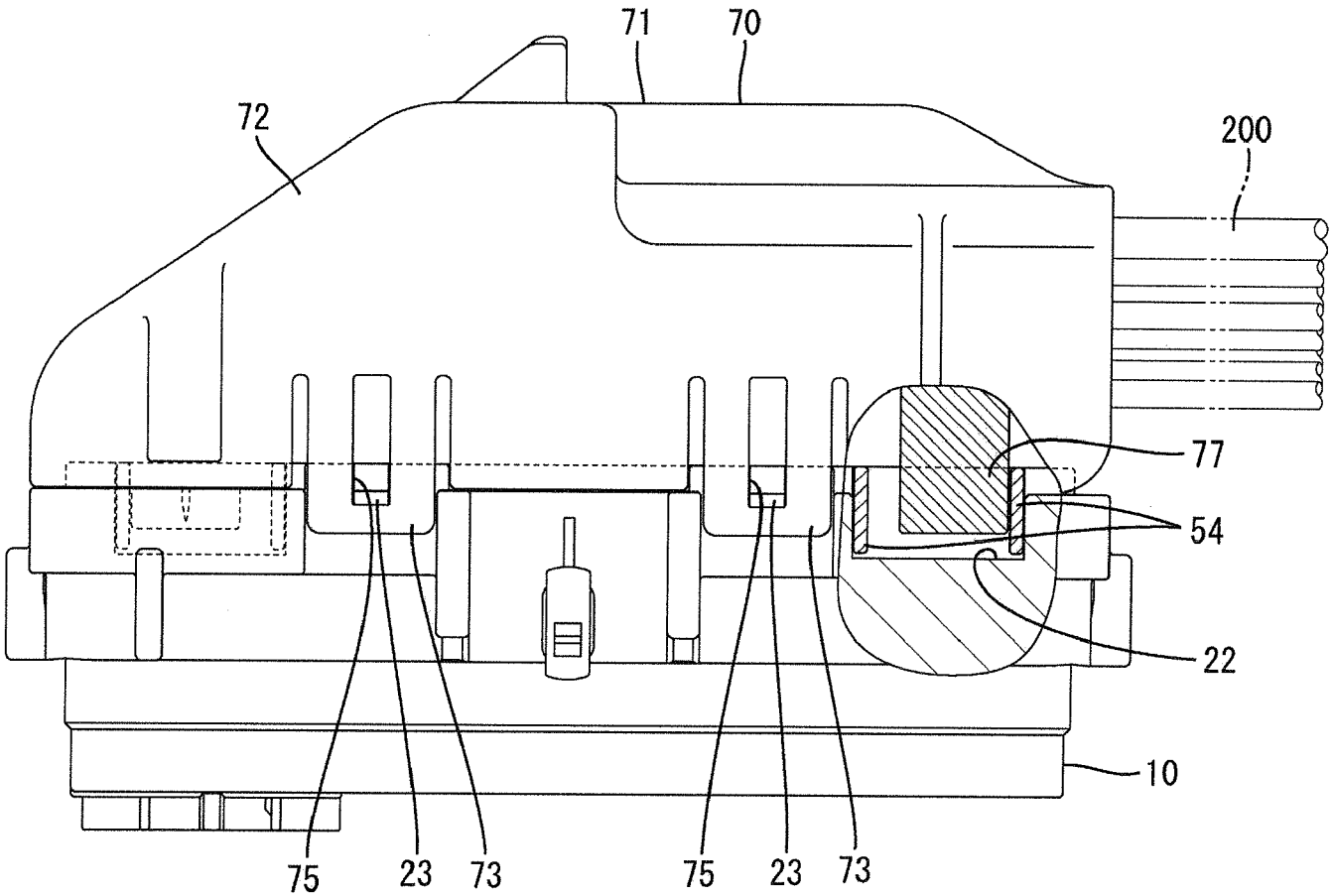
FIG. 15 is a plan view, partly in section, of the housing with the wire cover mounted thereon.

Thereafter as shown in FIGS. 14 and 15, the electric wire cover 70 is mounted on the housing 10 from the rear. When the electric wire cover 70 is mounted on the body housing 10, the corresponding cover-locking part 23 is fit elastically in the locking hole 75 of each locking leg 73. Hence, the electric wire cover 70 is held by the housing 10. When the electric wire cover 70 is mounted on the housing 10, the projected strips 77 are inserted into the corresponding concave grooves 22. In this case, the projected strips 77 are inside the concave grooves 22 communicating with the accommodation concavities 11 respectively with the projected strips 77 and the ribs 54 being arranged side by side (see FIG. 15). More specifically, each projected strip 77 is disposed in the gap between the ribs 54. By inserting the projected strips 77 into the concave grooves 22 respectively, the side plates 72 of the electric wire cover 70 are prevented from being deformed elastically outward. That is, the projected strips 77 prevent the electric wire cover 70 from being opened.

Another sub-connector 30B different from the sub-connector 30 corresponding to the accommodation concavity 11 can be accommodated therein. For example, in the case shown in FIG. 1, the other sub-connector 30B that should be accommodated in the upper row accommodation concavity 11B at the central portion in the width direction of the housing 10 can be accommodated in the upper row accommodation concavity 11A at one side of the housing 10 in the width direction. The reason for this is that because the concave groove 22 is widthwise narrow, the rib 54 of the other sub-connector 30B is inserted into the concave groove 22.

Let it be supposed that the other sub-connector 30B is accommodated erroneously in the accommodation concavity 11A. When the operator tries to mount the electric wire cover 70 on the body housing 10 in this state, the projected strip 77 interferes with the rib (rib 54B at the central portion in the width direction of the sub-connector 30B) 54 of the other sub-connector 30B. Thus, the operation of further inserting the projected strip 77 into the concave groove 22 is stopped. Because the operation of mounting the electric wire cover 70 on the body housing 10 is stopped, the other sub-connector 30B is secondarily prevented from being accommodated inside the wrong accommodation concavity 11A.

As described above, the front ends of the locking strips 59 of the holder 50 are shifted from each other in the longitudinal direction thereof, and the front ends of the lock receiving parts 37 of the sub-housing 31 are located at different positions in the longitudinal direction thereof. When the holder 50 takes the incorrect mounting posture relative to the sub-housing 31, the lock 60 of the one locking strip 59A cannot be fit on the corresponding lock receiving part 37A. Thus, the holder 50 is separable from the sub-housing 31 is not held by the sub-housing 31 in the incorrect mounting posture. Therefore the holder 50 is prevented from being erroneously mounted on the sub-housing 31.

When the holder 50 is pressed to the normal mounting position with the holder 50 in the incorrect posture relative to the sub-housing 31, the one locking strip 59A is disposed over the wall 39 of the sub-housing 31. Thus, the operator can determine that the holder 50 takes the incorrect mounting posture by visually checking this state.

The one locking strip 59A disposed over the wall 39 projects out from the other wall 38B. Therefore the operator can visually clearly recognize that the holder 50 takes the incorrect mounting posture.

By inserting the ribs 54 into the concave grooves 22 respectively, the sub-connector 30 can be accommodated inside the accommodation concavity 11 different from the accommodation concave part in which the other sub-connector 30 should be accommodated. However, when the operator tries to mount the electric wire cover 70 on the housing 10 in this state, the projected strip 77 interferes with the rib 54 inserted into the concave groove 22. Thus, the operation of mounting the electric wire cover 70 on the body housing 10 is stopped. The inability to mount the electric wire cover 70 on the housing 10 signals the operator that the sub-connector 30 is mounted on the wrong accommodation concavity 11. When the sub-connector 30 takes the normal mounting posture, the concave groove 22 is used commonly for the rib 54 and the projected strip 77. Thus the construction of the body housing 10 can be simplified.

The first through fourth curved surfaces 12, 13, 55, and 56 on the outer surface of the holder 50 and the inner surface of the accommodation concavity 11 function as the reverse insertion prevention parts. Thus, the inverted sub-connector 30 cannot be inserted into the accommodation concavity 11.

The invention is not limited to the embodiments described above with reference to the drawings. For example, the following embodiments are also included in the scope of the present invention.

Conversely to the above-described embodiment, the locking part receiving part may have a projected configuration, whereas the locking strip may have a groove configuration on which the locking part receiving part can be fitted.

Not less than three locking strips may be formed on the holder, and not less than three locking part receiving parts may be formed on the housing.

The rib may be formed on the sub-housing.

What is claimed is:

1. A connector comprising:

a plurality of sub-connectors, each of the sub-connectors having a rib, the ribs being at different positions on each of the sub-connectors;

a housing having a plurality of accommodation concavities into which said sub-connectors can be inserted respectively, grooves communicating respectively with the accommodation concavities, the grooves being disposed to receive the ribs; and a wire cover mounted on the housing and covering electric wires pulled out of the housing, the wire cover having a projected strip projected toward the housing, the projected strip being inserted into the groove side by side with the rib when the sub-connector is accommodated correctly in the accommodation concavity so that the wire cover is prevented from being opened, and the projected strip interferes with the rib in the groove when the sub-connector is accommodated incorrectly in the accommodation concavity to prevent mounting the electric wire cover on the housing.

2. The connector of claim 1, wherein each of the sub-connectors and each of the accommodation concavities includes at least one a reverse insertion prevention part for permitting each of the sub-connectors to be accommodated inside the respective accommodation concavities only in a specified rotational orientation.

3. The connector of claim 1, wherein the ribs on the sub-connectors and the grooves on the accommodation concavities are disposed so that the grooves can receive the ribs only in a specified rotational orientation of the sub-connectors relative to the respective accommodation concavities.

4. The connector of claim 1, wherein the projected strips are substantially planar.

5. A connector comprising:

a plurality of sub-connectors, at least one rib projecting out on each of the sub-connectors, the rib on at least one of the sub-connectors being at different position than the rib on at least another of the sub-connectors;

a housing having a plurality of accommodation concavities configured for receiving the respective sub-connectors, at least one groove being formed in each of the accommodation concavities respectively, each groove being disposed for receiving a rib of a corresponding one of the sub-connectors; and a wire cover mounted on the housing and covering electric wires pulled out of the housing, the wire cover having a projected strip projected toward the housing, the projected strip being inserted into one of the grooves side by side with the rib in the respective groove when the respective sub-connector is accommodated in a specified one of the accommodation concavities so that the wire cover is prevented from being opened, and the projected strip interferes with the rib in the groove when the sub-connector is accommodated incorrectly in the accommodation concavity to prevent mounting the electric wire cover on the housing.

6. The connector of claim 5, wherein each of the sub-connectors and each of the accommodation concavities includes at least one a reverse insertion prevention part for permitting each of the sub-connectors to be accommodated inside the respective accommodation concavities only in a specified rotational orientation.

7. The connector of claim 5, wherein the ribs on the sub-connectors and the grooves on the accommodation concavities are disposed so that the grooves can receive the ribs only in a specified rotational orientation of the sub-connectors.

* * * * *